US005560048A

United States Patent [19]

Root

[11] Patent Number: 5,560,048

[45] Date of Patent: Oct. 1, 1996

[54] WATER CLOSET EXHAUST COLLECTOR

[76] Inventor: Donald F. Root, 6930 Russell Rd., Twin Lakes, Mich. 49457

[21] Appl. No.: 411,465

[22] Filed: Mar. 28, 1995

[51] Int. Cl.[6] ..... F03D 9/05

[52] U.S. Cl. ..... 4/213; 4/348; 4/209 FF

[58] Field of Search ..... 4/213, 216, 209 FF, 4/347, 348, 352, 217

[56] References Cited

U.S. PATENT DOCUMENTS

| | | | |
|---|---|---|---|
| 625,125 | 5/1899 | Scutt | 4/352 |
| 1,885,715 | 11/1932 | Hanson | 4/213 |
| 2,023,127 | 12/1935 | Fairchild | 4/213 |
| 2,526,952 | 10/1950 | Kraus | 4/216 |
| 2,685,094 | 8/1954 | MacAillo | 4/216 |
| 4,974,632 | 12/1990 | Ericson | 4/209 FF |
| 5,105,479 | 4/1992 | Ross | 4/213 |
| 5,231,705 | 8/1993 | Ragusa | 4/213 |

*Primary Examiner*—Henry J. Recla
*Assistant Examiner*—Charles R. Eloshway
*Attorney, Agent, or Firm*—Wilfred O. Schmidt

[57] ABSTRACT

An exhaust collector comprising an underside intake secured within the interior of a toilet by a detachable and compressible mounting of the connecting conduit to the sidewall through which it extends to draw discharged odoriferous gases away from the person of the user by means of biased air.

7 Claims, 3 Drawing Sheets

WATER CLOSET EXHAUST COLLECTOR

FIELD OF INVENTION

The present invention relates to an Exhaust Collector comprising an underside intake secured within the interior of a toilet by a detachable and compressible mount assembly fixing and sealing the connecting conduit to the toilet side wall through which it extends, to draw discharged odoriferous gases from the person of the user and exhaust the same to an outside air space by means of biased air.

PRIOR ART

The prior art has recognized the problem of removing objectionable body discharged gases from bathrooms as a means of making the bathroom and environs more pleasant and habitable. Flush toilets, particularly those located in public rest rooms, have for a long time been a source of offensive odors.

A prior art odor eliminating method involves the use of a remotely mounted exhaust fan. The exhaust fan has the disadvantage that it must displace a large quantity of air from the rest room to the out-of-doors. As the result of fan biasing the air, there is a dispersal of offensive odors away from the toilet and into the room before exhausting to the out-of-doors.

Other prior art odor eliminating systems use add-on units for attachment to conventional toilets having the usual bowl, tank and folding seat arrangements. These systems have heretofore not used a means internal of the toilet to effectively eliminate discharged offensive body odors.

PRESENT INVENTION

The odor collecting means of the present invention is safe, simple, easy to install and clean and almost totally concealed.

The odor collecting means is an underside intake secured within the interior of the toilet and situated at all times close to the source emitting odoriferous gases. By means of an air-moving devise, a conventional air fan, the gases are collected at the source and exhausted to an outside air space.

The air-moving device can be actuated by the weight of the user closing a suitable pressure switch electrically connected and mounted on the bottom side of the toilet seat. Alternatively, the air-moving device can be actuated by the user manually closing the switch or by turning on the room lighting circuit to which the air-moving device is electrically connected.

OBJECTIVES

It is an object of the present invention to provide a means that eliminates odoriferous gases from within the toilet.

It is a further object of the present invention to provide a means that may be readily adapted to a variety of existing flush toilets.

It is a further object of the present invention to provide a means that allows a minimum of air flow to be exchanged between the rest room, toilet and the exhaust location.

It is yet another object of the present invention to provide an odoriferous gas eliminating means that is primarily concealed and is of sanitary construction.

DESCRIPTION OF THE PREFERRED EMBODIMENT

Figure 1:
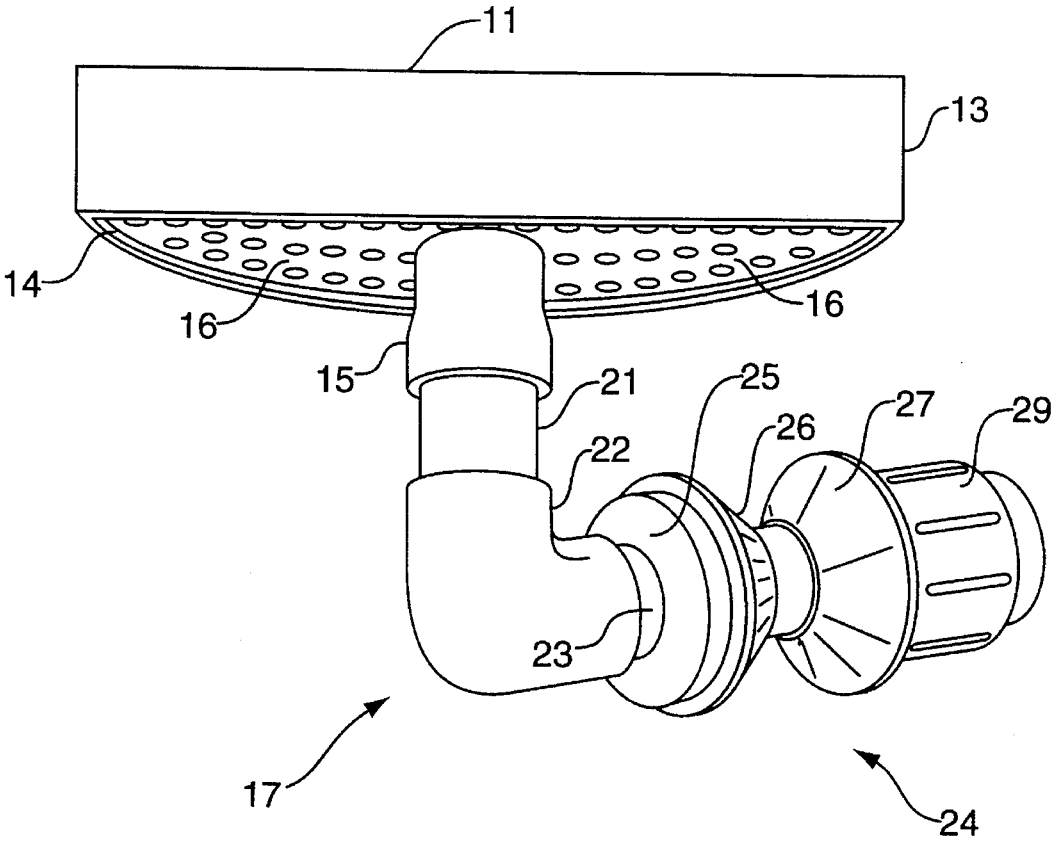
FIG. 1. Perspective illustration of the invention.

With reference to the illustration in FIG. 1., the present invention is an Exhaust Collector 11 comprising a contoured head plate 12 (FIG. 3) having a downward extending perpendicular continuous flange 13 of given uniform width permanently fixed to the periphery of the head plate 12. The continuous flange 13 forming and open bottom underside enclosure 14 circumscribing an intake volume.

A cylinder stem 15, in perpendicular relationship with the head plate 12 is fixed within and at the midpoint of the underside enclosure 14. The stem 15 communicates with the underside enclosure 14 by means of a passage through the upper end of the stem 15 defined by two orifices (FIG. 4) contained within the intake volume 14. The stem 15 connects to the conduit assembly 17.

The conduit assembly 17 consists of connection 21, an angled connection 22 and connection 23 and leads through the detachable and compressible mount assembly 24.

The detachable and compressible mount assembly 24 consists of an inside retainer ring 25 permanently fixed to the periphery of connection 23; an inside rubber seal 26; an outside rubber seal 27; a removable retainer ring 28 (FIG. 4); and, a retainer support 29 which is fitted with a wrench grasping means.

Figure 2:
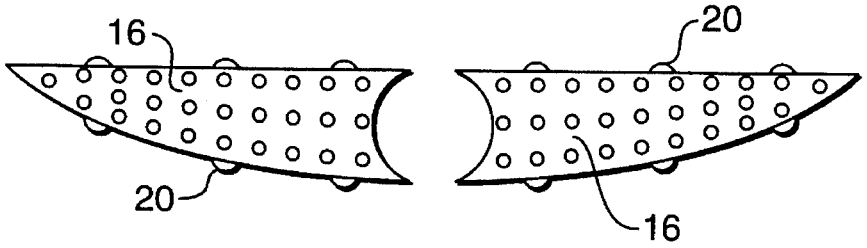
FIG. 2. Illustration of the segmented contoured snap-in screen

The reference to the illustration in FIG. 2, is a snap-in segmented contoured screen 16 fixed with pressure retainers 20. The screen 16 is segmented to fit about the stem 15 protruding from the underside enclosure 14. The contour of the segmented screen 16 must follow the contour of the head plate 12 to effect a complete screen of the underside enclosure 14.

Figure 3:
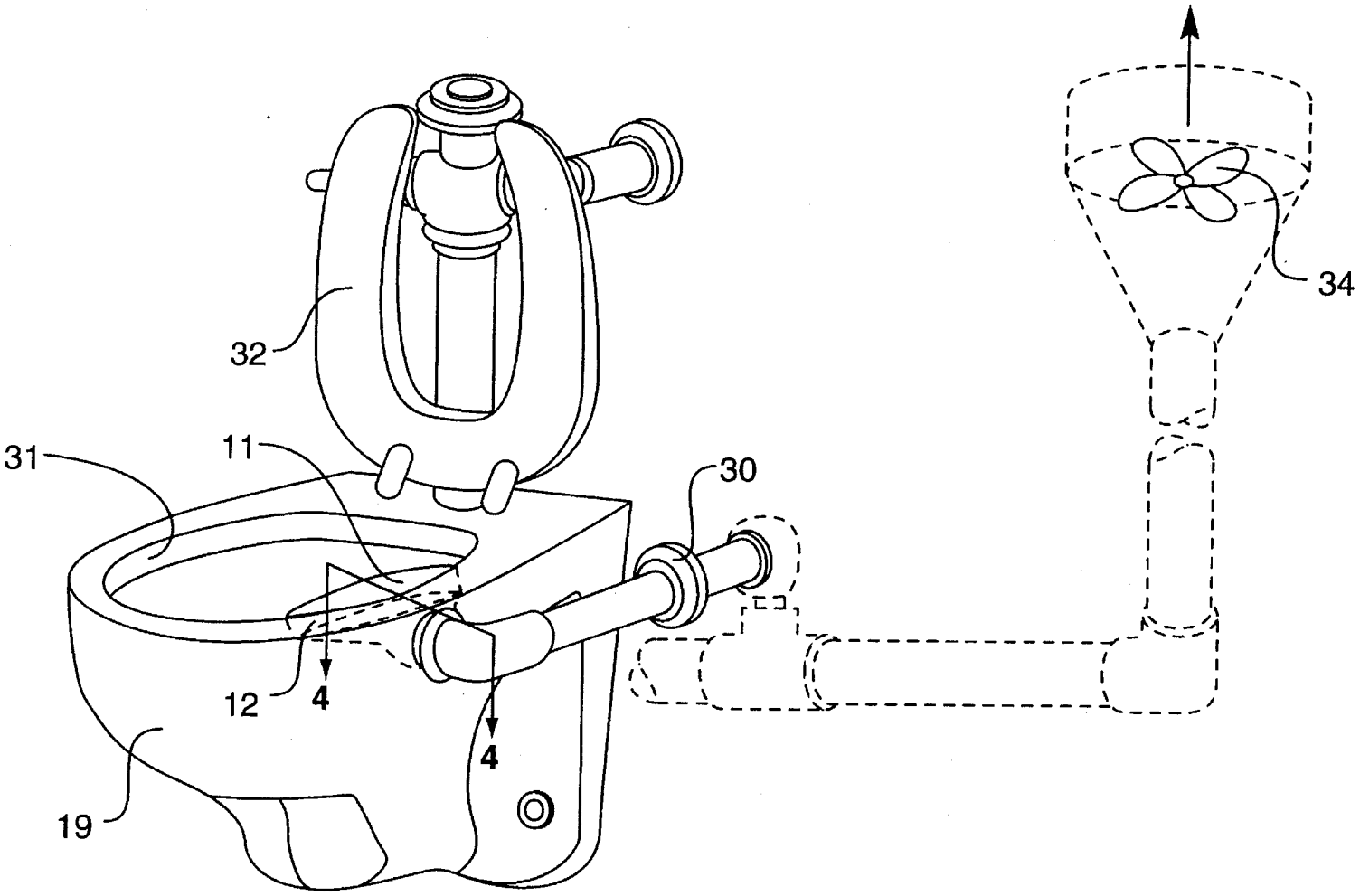
FIG. 3 Perspective illustration of an application of the invention

The reference to the illustration in FIG. 3, is a primarily concealed Exhaust Collector 11 within the interior of the toilet 19.

The Exhaust Collector 11 is shown positioned adjacent to the upper rim 31 of a toilet 19 and by way of stem 15 connects to conduit assembly 17 which extends through the sidewall 18 (FIG. 1). Thereafter, by conduit coupling 30 with a second conduit connection is made to the air-moving device 34. The air-moving device 34 is shown in dotted outline denoting it to be enclosed in the wall structure.

Figure 4:
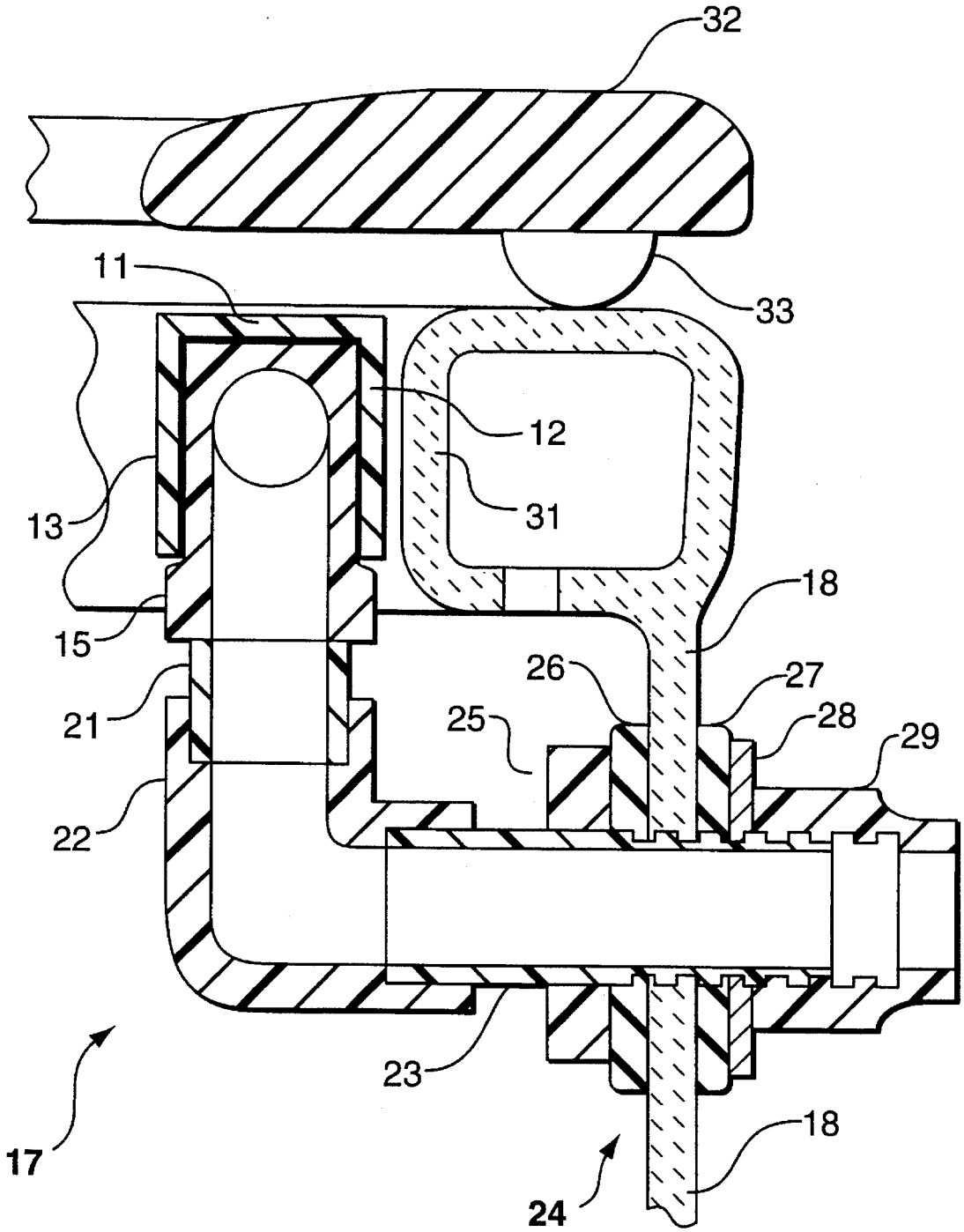
FIG. 4. Illustration of the vertical section through line 4—4 on FIG. 3.

The reference to the illustration in FIG. 4., is the vertical section of the present invention through the line 4—4 of FIG. 3.

The open bottom underside enclosure 14 of Exhaust Collector 11 exhausts through the plural communicating orifice in stem 15. The conduit assembly 17 leads from stem 15 through sidewall 18 to the detachable and compressible mount assembly 24.

The assembly 24 has in the main similar components inside and outside of the sidewall 18 (FIG. 1).

The connection 23 of conduit assembly 17 has an external threaded end section. The retainer support 29 of the detachable mount assembly 24 has an internal threaded front end section. By the tightening of the threaded engagement between the connection 23 and the the retainer support 29 the mount assembly 24 is compressed against the permanently attached inside retainer ring 25.

The compression serves to fix and seal the conduit assembly 17 to sidewall 18 through which it extends and collaterally serves to secure the Exhaust Collector 11 within the interior of toilet 19.

INSTALLATION AND OPERATION

The air movement into, through and exhausted from the Exhaust Collector is directly related to the negative pressure or vacuum within the intake volume.

In the application of the Exhaust Collector, the intensity of negative pressure or vacuum to be realized within the intake volume is dependent on the capacity of the air-moving device taken in combination with the size of the intake volume and the restriction to the exhaustion of air from the intake volume imposed by the communicating orifices within the cylindrical stem.

These relationships must be taken into account when a series of toilets equipped with the Exhaust Collector are ganged to one air-moving device.

In operation the user's anatomy serves to seal the opening of the toilet seat. Under the urging of the air-moving device, room air is drawn into the toilet bowl through the space between the toilet seat supports and the upper rim of the toilet. Consequently the room air intake mixed with the discharged odoriferous gases within the toilet is drawn downward and away from the user and into the underside intake enclosure of the Exhaust Collector. Then through the conduits and the conduit coupling the mixture of gases is exhausted to an outside airspace.

The underside intake enclosure of the Exhaust Collector has vertical sides. Any water that splashes into the underside intake enclosure will under the urging of gravity return to the toilet bowl.

Further the underside intake enclosure is covered by a screen. In the event of an overflow or back up, the screen will prevent most particular matter from being drawn into the underside intake enclosure. In the event smaller particular matter is caught or drawn through the screen, the underside intake enclosure can be readily cleaned by uncoupling the conduit coupling to the air-moving device and releasing the detachably mounted conduit assembly from the toilet bowl sidewall.

Although the invention has been described by reference to the preferred embodiment, it will become apparent that changes can be made which will be in keeping with the scope of the invention.

The embodiments of the invention in which an exclusive property or privilege is claimed are defined as follows:

1. An exhaust collector for exhausting odoriferous gases from within a toilet bowl, said toilet including an upper rim having a curved inner surface, said exhaust collector comprising:

an intake including a head plate adapted to be placed adjacent to, and contoured to conform with, a section of said curved inner surface of said upper rim, a continuous flange of uniform width extending about and downwardly from said head plate, said head plate and flange enclosing an intake volume, a cylindrical stem mounted perpendicularly to an underside of said head plate within, and at a midpoint of, said intake volume, said stem further having a plurality of orifices in communication with said intake volume, and, a segmented screen contoured to conform shapewise with said head plate, each segment of said screen being releasably fastened to said flange and about said cylindrical stem for screening said intake volume from water in said toilet;

a conduit connected to said cylindrical stem and adapted for extending through a sidewall of said toilet;

a detachable and compressible mount adapted for fixing and sealing said conduit to said sidewall; and, a blowing means for exhausting air from said toilet through said intake volume, said stem, and said conduit.

2. The structure of claim 1, in which-said detachable and compressible mount is comprised of two opposing rubber seals of conical shape.

3. The structure of claim 1, wherein said head plate has a cycloidal contour.

4. The structure of claim 1 wherein said upper rim of said bowl has a width and the cylindrical stem has a predetermined diameter, said continuous flange having a uniform width which is less than the width of the upper rim and greater than the diameter of said stem.

5. An exhaust collector adapted to be secured within an interior portion of a toilet bowl adjacent to, and just below a section of an upper rim of, said bowl, comprising:

a top surface having one side contoured to conform with a curved inner section of said upper rim, and an opposite side having a straight edge connecting terminal ends of said contoured side;

a continuous flange of uniform width attached about said sides of said top surface and extending downwardly therefrom, said top surface and flange forming an open-bottomed intake;

a hollow stem connected to said top surface and located between the opposing sides of said top surface and at a midpoint of said intake, said stem having a plurality of orifices in communication with said intake;

a conduit connected to an end of said hollow stem and adapted for extending through a sidewall of said toilet;

a detachable and compressible mounting adapted for fixing and sealing said conduit to said sidewall; and, a blowing means operatively coupled to said conduit externally of said toilet and at a distance from said mounting; whereby, upon operation of said blowing means, air within said toilet bowl is collected by said intake and exhausted therethrough into said conduit and out through said blowing means.

6. The structure of claim 5, in which said open-bottomed intake is enclosed by a segmented contoured screen.

7. The structure of claim 5, further including a retainer support operatively associated with said mounting, said support including a wrench grasping means for allowing the retainer to be moved by a wrench to compress said mounting.

* * * * *